United States Patent [19]

Hall

[11] Patent Number: 4,674,706

[45] Date of Patent: Jun. 23, 1987

[54] PROJECTILE WITH AN EXTENDABLE BOATTAIL

[76] Inventor: Robert C. Hall, P.O. Box 811, Atlanta, Tex. 75551

[21] Appl. No.: 831,603

[22] Filed: Feb. 21, 1986

[51] Int. Cl.[4] ..... F42B 13/273

[52] U.S. Cl. ..... 244/3.3; 102/489

[58] Field of Search ..... 244/3.3; 102/489, 398

[56] References Cited

U.S. PATENT DOCUMENTS

| | | | |
|---|---|---|---|
| 229,499 | 6/1880 | Turner | 244/3.3 |
| 399,880 | 3/1889 | Graydon | 244/3.3 |
| 2,297,130 | 9/1942 | Bomar | 244/3.3 |
| 3,282,216 | 11/1966 | Calfee et al. | 244/3.3 |
| 3,412,962 | 11/1968 | Killian | 244/3.3 |

FOREIGN PATENT DOCUMENTS

| | | | |
|---|---|---|---|
| 1459354 | 11/1966 | France | 244/3.3 |

*Primary Examiner*—Deborah L. Kyle
*Assistant Examiner*—Michael J. Carone
*Attorney, Agent, or Firm*—John M. Harrison

[57] ABSTRACT

A projectile having a streamline assembly which includes a frusto-conical saddle secured to the boattail area of the projectile bullet, a carrying cylinder having one end secured to the saddle, with multiple, concentrically oriented, tapered, collapsible rings normally located inside the opposite end of the carrying cylinder and biased against a pressure disk fitted against the opposite end of the carrying cylinder, wherein firing of the projectile causes the pressure disk to tear away from the carrying cylinder and deploy the collapsible rings outwardly of the carrying cylinder and behind the bullet in a "beehive" configuration, to reduce air resistance as the projectile moves through the atmosphere. In a preferred embodiment the pressure disk is pressed against the carrying cylinder by means of a brass screw, the threads of which engage an aperture in the saddle and are stripped from the brass screw to release the disk when the projectile is fired.

8 Claims, 6 Drawing Figures

PROJECTILE WITH AN EXTENDABLE BOATTAIL

BACKGROUND OF THE INVENTION

1. Field of the Invention

This invention relates to projectiles such as bullets and shells which are fired from guns and rifles and more particularly, to artillery and rifle projectiles which are characterized by a solid bullet and a streamline assembly carried by the bullet for reducing air resistance as the bullet is propelled through the atmosphere. The projectile of this invention is particularly well suited for artillery application and is designed to facilitate greater range, accuracy and efficiency than is possible with conventional shells or bullets. This increase in range, accuracy and efficiency is promoted by a streamline assembly which is attached to the solid shell or bullet and operates to reduce wind resistance. The streamline assembly includes a hollow carrier cylinder which is attached at one end to a saddle fixed to the squared-off or boattail end of the shell or bullet. Multiple, tapered, collapsible rings are arranged in nested configuration inside the carrier cylinder and are biased to expand outwardly of the carrier cylinder by a spring. A pressure disk is fitted with a brass screw for threadibly engaging the saddle and securing the pressure disk against one end of the carrier cylinder and forcing the collapsible plates inside the carrier cylinder against the bias of the spring before the projectile is fired. Upon firing, air pressure and vacuum behind the pressure disk operate to tear the pressure disk from the carrier cylinder by stripping the screw threads to deploy the collapsible plates in a "beehive" configuration behind the shell or bullet.

2. Description of the Prior Art

Conventional bullets, shells and projectiles are shaped with a rounded tip and a blunt trailing end or base which provides a flat surface area for propelling the bullet from a barrel due to expanding gases. Some shells are shaped to define a "boattail" tapered rear surface, which configuration somewhat improves the ballistics of the bullet. However, it has long been known that considerable "drag" is realized when a bullet or shell is propelled through the air, even when this "boattail" design is implemented. This "drag", or air resistance is the result of air piling up ahead of the bullet or shell and forming eddies and currents inwardly of the shell or bullet base, resulting in a suction or vacuum behind the bullet or shell, which reduces the speed of the projectile. Many of the larger projectiles, such as artillery shells, are fitted with a copper band which encircles the shell at the point of maximum diameter to engage the rifling in the barrel and rotate the shell as it traverses the barrel.

Conventional shells and bullets are propelled by two basic techniques. The larger shells, such as navy artillery shells, are frequently loaded into the barrel of large navy guns and are propelled by a powder charge loaded in the barrel rearwardly and separately of the shell. Other shells and bullets are sealed in a cartridge containing a primer and the necessary powder charge and firing of the shell or bullet is effected by striking the primer and igniting the powder. The projectile of this invention can be adapted to both basic firing techniques.

Accordingly, it is an object of this invention to provide a new and improved projectile which is fitted with a streamline assembly for streamlining the bullet or shell element of the projectile.

Another object of the invention is to provide a new and improved shell or bullet which is characterized by a streamline assembly attached to the rear end thereof, which streamline assembly is adapted to deploy rearwardly of the shell or bullet in a "beehive" configuration when the shell or bullet is fired from a rifle or gun.

Still another object of this invention is to provide a streamlined projectile which includes a shell or bullet portion having a blunt impact end and a truncated rear portion or base, with a carrier cylinder attached at one end to the base of the shell or bullet and multiple, concentric, collapsible rings biased and nested inside the opposite end of the carrier cylinder by a spring and a pressure disk pressed against the open end of the carrier cylinder and the rings, wherein air pressure and vacuum operate to remove the pressure disk from the carrier cylinder and allow the rings to deploy outwardly of the carrier cylinder responsive to pressure from the spring when the bullet or shell is fired from a gun or rifle.

Another object of the invention is to provide a projectile which incorporates a streamlined enclosure for reducing air resistance during flight, which enclosure is characterized by a hollow cylinder secured to a saddle fixed to a bullet or shell portion and multiple, concentrically oriented, tapered rings normally collapsed into the cylinder and deployed by means of air pressure and vacuum from the end of the cylinder when the shell or bullet is fired.

SUMMARY OF THE INVENTION

These and other objects of this invention are provided in a streamlined projectile which includes a bullet or shell element having a blunt impact end and a flat base portion, with a truncated, tapered saddle attached to the base portion and a cylinder secured to the saddle and further including multiple, tapered, telescoping, concentric rings spring-loaded and nested inside the cylinder by means of a pressure disk which closes one end of the cylinder. A brass screw extends through the interior of the cylinder and engages the saddle and air pressure applied against the pressure disk strips the threads on the brass screw and pulls the screw from the saddle, thus removing the pressure disk from the cylinder and allowing the rings to deploy rearwardly of the cylinder in a "beehive" configuration behind the bullet or shell element when the projectile is fired from a gun or rifle.

BRIEF DESCRIPTIOIN OF THE DRAWING

The invention will be better understood by reference to the accompanying drawing, wherein.

DESCRIPTION OF THE PREFERRED EMBODIMENTS

Figure 1:
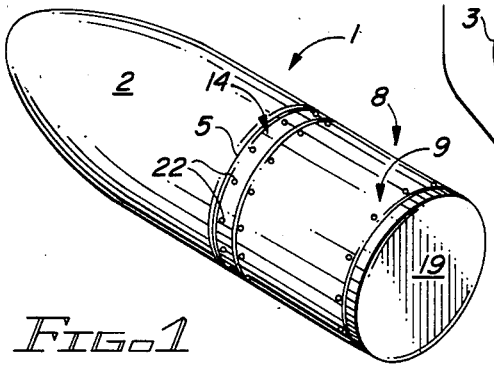
FIG. 1 is a perspective view of the projectile of this invention, with the streamline assembly illustrated in retracted, non-functional configuration.
Figure 2:
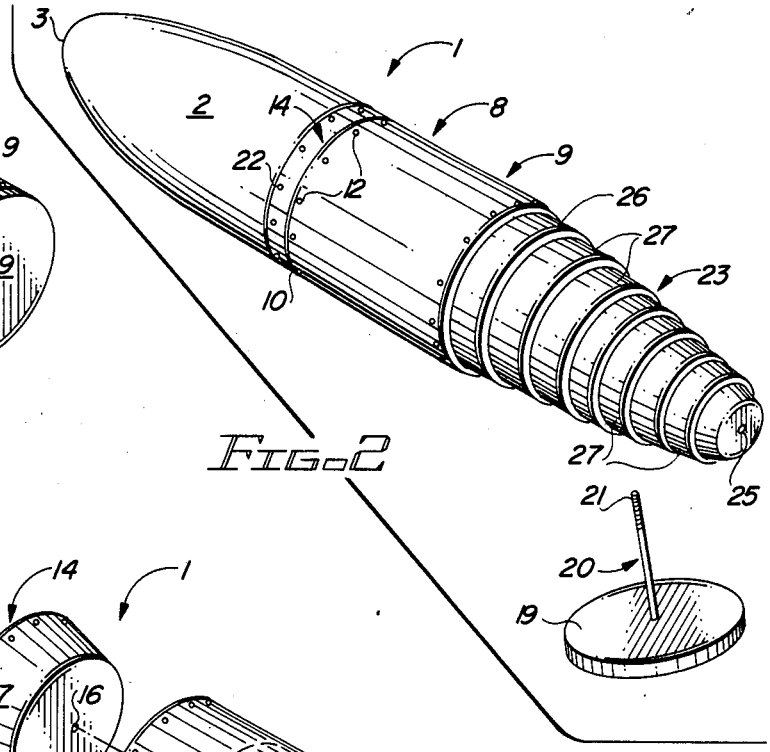
FIG. 2 is a perspective view of the projectile illustrated in FIG. 1, with the streamline assembly in functional deployed configuration.
Figure 3:
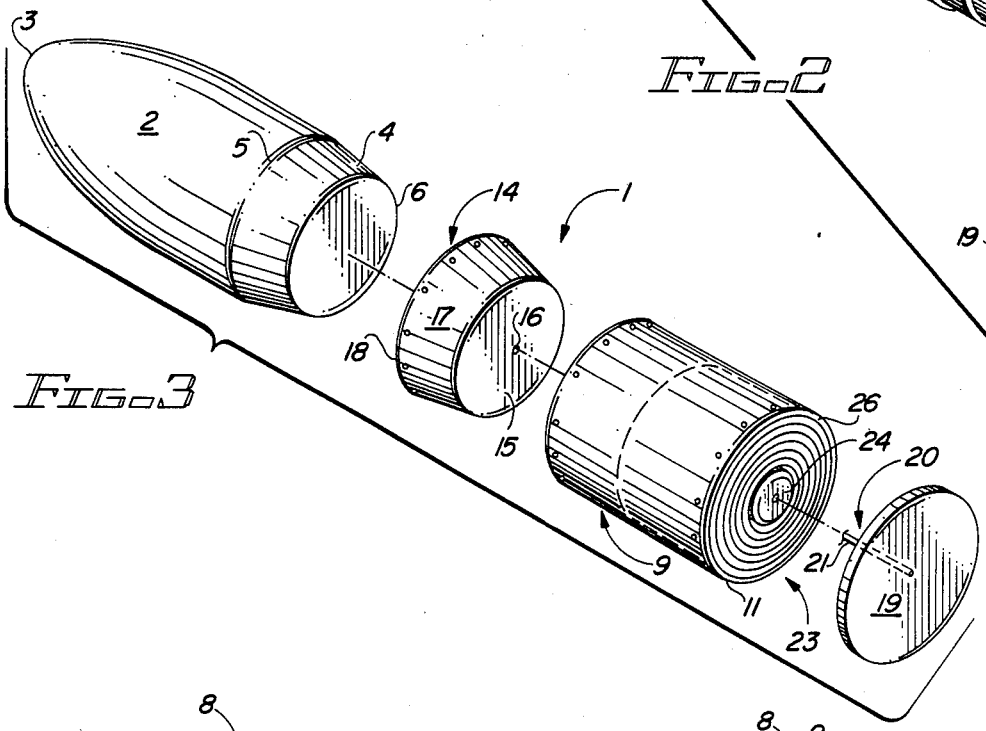
FIG. 3 is an exploded view of the projectile illustrated in FIG. 1.

Referring initally to FIGS. 1–3 of the drawing in a preferred embodiment, the projectile of this invention is illustrated by reference numeral 1. The projectile 1 is characterized by a bullet portion 2 having a rounded contact or impact tip 3, extending rearwardly to a margin 5. In another preferred embodiment of the invention the bullet portion 2 is shaped to define a boattail 4, which tapers inwardly from the margin 5 to define the perimeter of a flat base 6. A saddle 14 is riveted or otherwise attached near the leading edge 18 to the boattail 4 of the bullet portion 2 by means of saddle rivets 22. The saddle 14 is an integral component of a streamline assembly 8, which extends behind the bullet portion 2. A second component of the streamline assembly 8 is the carrier cylinder 9, an open end 10 of which is attached to th saddle 14 by means of shell rivets 12, as illustrated. The opposite, or disk end 11 of the carrier cylinder 9 is closed by a pressure disk 19, which is secured to the saddle 14 by means of the brass screw 20, as hereinafter described.

Referring to FIGS. 1–3 of the drawing, in a preferred embodiment, the streamline assembly 8 further includes multiple, concentrically oriented, tapered, collapsible rings 23, which are nested in the disk end 11 of the carrier cylinder 9. The collapsible rings 23 are biased inside the carrier cylinder 9 by means of a spring, as hereinafter further described and are maintained inside the carrier cylinder 9 by the pressure disk 19, which acts as a cap closing the disk end 11 of the carrier cylinder 9. A brass screw 20 extends from the center of the pressure disk 19 inwardly of the carrier cylinder 9 through a plate aperture 25 located in the closure ring 24 of the collapsible ring 23, and the threads 21 of the brass screw 20 engage a base aperture 16 located in the saddle base 15 of the saddle 14. Accordingly, as illustrated in FIG. 1, the pressure disk 19 is maintained on the disk end of the carrier cylinder 9 by operation of the brass screw 20.

Figure 4:
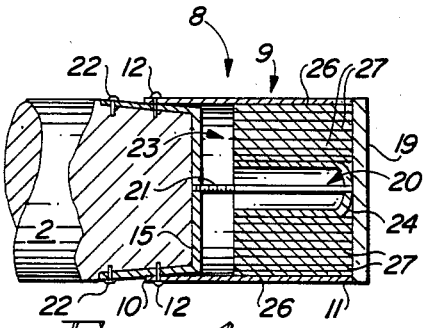
FIG. 4 is a sectional view of the projectile streamline assembly with the spring removed, to highlight the collapsible ring detail.
Figure 6:
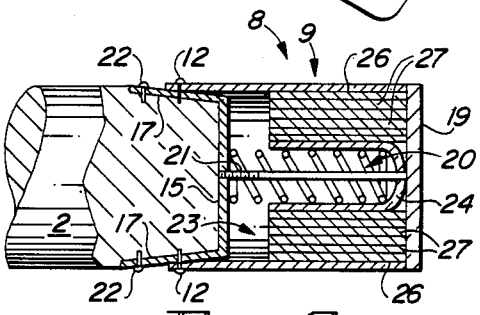
FIG. 6 is a sectional view of the projectile streamline assembly illustrated in FIG. 4, with the spring located inside the closure ring.

Referring now to FIGS. 4 and 6 of the drawing, in another preferred embodiment of the invention the middle one, or closure ring 24 of the collapsible rings 23 is hollow in order to accomodate a coil spring 13, which extends from the saddle base 15 of the saddle 14 to the dome-shaped end of the closure ring 24, as illustrated in FIG. 6. Furthermore, each of the collapsible rings 23 are tapered and are larger in diameter at the base end closest to the saddle base 15 than at the opposite end, which rests against the pressure disk 19. When the collapsible rings 23 are positioned as illustrated in FIGS. 1,3,4 and 6, the tension in the spring 13 forces the closure ring 24 against the pressure disk 19 and the pressure disk 19 is held in place by means of the brass screw 20, as heretofore described.

Figure 5:
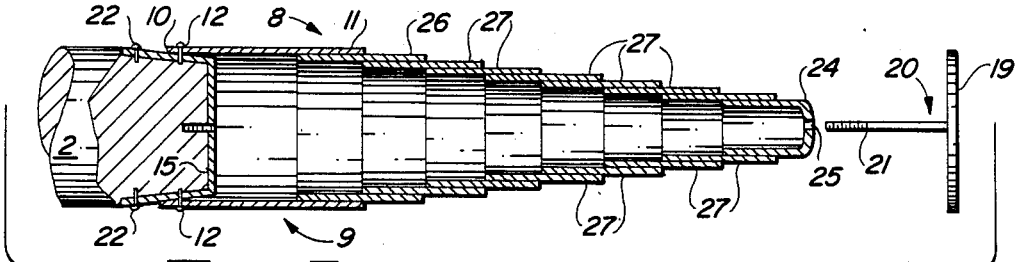
FIG. 5 is a sectional view of the streamline assembly in fully deployed configuration.

Referring to FIGS. 2 and 5 of the drawing, firing of the projectile 1 results in a positive air pressure applied to the perimeter of the pressure disk 19 and a vacuum or suction applied to the outer surface of the pressure disk 19 due to the travel of the projectile 1 through the atmosphere. This combined force is effective to strip the threads 21 from the brass screw 20 and cause the pressure disk 19 to fall away from the carrier cylinder 9, as illlustrated in FIG. 2. When the pressure disk 19 falls away from the carrier cylinder 9, the spring 13 forces the closure ring 24 outwardly of the carrier cylinder 9, a movement which triggers extension of the collapsible rings 23, including the outside ring 26 and the interior rings 27, to the configuration illustrated in FIGS. 2 and 5. Since the collapsible rings 23 are each larger at the base than at the top, they will not exit the carrier cylinder 9, but instead successively engage each other at the base end to form a "beehive" or cone configuration, as illustrated in FIG. 2. This deployment of the collapsible rings 23 operates to streamline the projectile 1 and minimize the influence of eddying air currents which normally appear at the base of conventional projectiles and bullets. This streamlining effect facilitates greater speed, efficiency and accuracy of the projectile 1, since the air is cleaved more perfectly and the resulting trajectory is more predictable. The end result is a strategic advantage over the enemy under circumstances where both large artillery shells and smaller projectiles such as bullets having the design of the projectile 1 are used in battle.

Another advantage of the projectile 1 is the creation of a larger surface area for operation of the expanding gases when the projectile 1 is propelled from the barrel of a gun or a rifle than is available when conventional boattail shells or truncated bullets are used. For example, referring again to FIG. 3 of the drawing, if a conventional boattail shell represented by the bullet portion 2 of the projectile 1 is fired from a gun or rifle, the reduced surface area of the base 6 is acted upon by the gases resulting from exploding powder, to propel the bullet portion 2 from the barrel. Since the boattail 4 is tapered, some of this expanding gas escapes around the bullet portion 2 and is lost for purposes of propulsion. However, under circumstances where a pressure disk 19 such as that illustrated in FIG. 1 is used in the streamline assembly 8, a larger surface area is presented for operation of the expanding gases to effect a greater speed of the bullet portion 2 through the atmosphere. For example, under circumstances where a 155 mm boattail artillery shell is fired from a gun, and referring again to FIG. 3, the base 6 presents about 12 square inches of propulsion area to the expanding gases. However, under circumstances where a pressure disk 19 such as that illustrated in FIG. 1 is used in a projectile 1, about 27 square inches of propulsion area is presented to the expanding gases while thrusting the projectile 1 from the barrel. The gas expands at a pressure of about 30,000 pounds per square inch and simple calculation shows that over twice as much thrust is created using the projectile 1 with the pressure disk 19 as is available in conventional boattail shells. Since the streamlining effect of the projectile 1 facilitates a more rapid passage of the bullet portion 2 through the atmosphere, the result is not only greater range and accuracy, but also greater efficiency of impact at the target. Accordingly, a bullet portion 2 of smaller size than would normally be required in conventional weaponry will effect the same impact as a larger shell and will be delivered at greater accuracy and higher speed than the conventional shell counterpart. The implicatons of such streamlining are not only the presentation of a shell of greater efficiency, but also one which better penetrates armor, particularly under circumstances where a tungston carbide tip 3 or other armor-piercing material is placed in the bullet portion 2. The improvement in performance characteristics of the projectile 1 is achieved without the requirement of increasing the size or strength of the gun or rifle used to fire the shell and no modification of existing guns and rifles using the projectile 1 is therefore necessary.

Although primarily designed for use in artillery pieces requiring separate loading of the bullet or shell and the powder charge for firing the shell, it will be appreciated that the projectile of this invention is also designed for use with conventional shell casings. Under these circumstances, both the bullet portion 2 and the streamline assembly 8 are inserted in the shell casing and the pressure disk 19 and carrier cylinder 9 are designed to fit tightly inside the casing. The bullet portion 2 is then fired in conventional manner by impacting the casing primer and the collapsible rings 23 are deployed in the manner described above, with the pressure disc 19 pulled from attachment to the saddle base 15 of the saddle 14 due to air pressure.

It will be appreciated by those skilled in the art that while a coil spring 13 is illustrated in FIG. 6 for deployment of the closure ring 24, outside ring 26 and the interior rings 27 externally of the carrier cylinder 9, other means can be used to achieve this result. For example, the domed end of the closure ring 24 can be attached by means of an adhesive or other technique to the pressure disk 19 such that when the pressure disk 19 is pulled outwardly of the carrier cylinder 9, it pulls the closure ring 24 from the carrier cylinder 9 to deploy the interior rings 27 and outside ring 26 and the pressure disk 19 subsequently breaks away from the closure ring 24. Other techniques for deploying the collapsible rings 23 from the interior of the carrier cylinder 9 will be apparent to those skilled in the art.

It will further be apparent to those skilled in the art that the streamline assembly 8 can be attached to the bullet portion 2 of the projectile 1 either in the field or during manufacture, as desired. In this regard, while saddle rivets 22 and shell rivets 12 are preferred fasteners for attachment of the saddle 14 to the bullet portion 2 and the carrier cylinder 9 to the saddle 14, other techniques known to those skilled in the art can also be used to effect this attachment. Furthermore, the saddle 14, carrier cylinder 9 and the collapsible rings 23 can all be manufactured of a light-weight material such as plastic or aluminum, which adds very little to the weight of the bullet portion 2 and yet will function efficiently to provide the "beehive" configuration illustrated in FIG. 2 for streamlining the projectile 1. Similarly, the pressure disk 19 can also be fabricated of a light-weight material such as plastic or aluminum and while the preferred material of construction of the brass screw 20 is brass, an aluminum screw 20 can also be used to achieve the same result. Other materials of construction can be used to fabricate the streamline assembly 8 according to the knowledge of those skilled in the art.

While the preferred embodiments of the invention have been described above it will be recognized and understood that various modifications may be made therein and the appended claims are intended to cover all such modifications which may fall within the spirit and scope of the invention.

Having described my invention with the particularity set forth above, what is claimed is;

1. A projectile adapted for propulsion from a barrel, said projectile comprising a bullet portion; a saddle attached to said bullet portion; a cylinder having one end attached to said saddle; a pressure disk closing the opposite end of said cylinder; a threaded member projecting from said pressure disk and a base aperture provided in said saddle for receiving the extending end of said threaded member and securing said pressure disk against said opposite end of said cylinder; a plurality of tapered ring means normally disposed in concentric, nested relationship inside said cylinder and a closure ring positioned in the center of said cylinder, said closure ring provided with a dome for closing said cylinder, whereby propulsion of said projectile from the barrel causes said pressure disk to break away from said opposite end of said cylinder and said tapered ring means to deploy from said cylinder in staggered relationshsip to assume a "beehive" configuration.

2. The projectile of claim 1 wherein said threaded member is a screw projecting through said dome of said closure ring, said screw engaging said base aperture provided in said saddle.

3. A prorjectile adapted for firing from the barrel of a gun, said projectile comprising a shaped bullet portion having a boattail rear end; a truncated saddle secured on said boattail rear end of said bullet portion; a hollow cylinder having one end attached to said saddle; a tapered outside ring located adjacent the inside surface of said cylinder; a plurality of successively smaller, tapered interior rings provided in concentric, nested relationship inside said outside ring; and a tapered closure ring positioned interiorly of the smallest of said interior rings, said closure ring further comprising a dome closing one end of said closure ring; a coil spring located in said cylinder, with one end of said coil spring seated against said saddle and the opposite end of said coil spring seated against said dome closing said one end of said closure ring; a pressure disk fitted against said opposite end of said cylinder and a screw projecting from said pressure disk and extending through said cylinder and engaging said saddle for removably securing said pressure disk against said opposite end of said cylinder to contain said rings inside said cylinder, whereby movement of said projectile through the air strips said screw from said saddle and causes said pressure disk to fall away from said cylinder to facilitate deployment of said rings outwardly of said cylinder in a closed "beehive" configuration.

4. A projectile adapted for firing from the barrel of a gun or rifle, said projectile comprising:

(a) a bullet having a blunt impact surface and a truncated base spaced from said impact surface;

(b) a saddle secured to said base;

(c) a hollow cylinder having one end fixedly secured to said saddle and the opposite end spaced from said saddle;

(d) a plurality of tapered rings having successively smaller diameters extending from the base to the top thereof, respectively, said rings arranged in normally nested, concentric relationship in said opposite end of said cylinder;

(e) a pressure disk seated against said opposite end of said cylinder and a threaded member extending from said pressure disk through said cylinder and threadibly engaging said saddle for closing said pressure disk against said opposite end of said cylinder; and (f) bias means extending between said saddle and said rings for biasing said rings against said pressure disk, whereby said rings are maintained inside said cylinder before said projectile is fired from said barrel and said rings are deployed outwardly of said cylinder in a cone-shaped configuration when said projectile is fired from said barrel and said pressure disk is removed from said opposite end of said cylinder, responsive to movement of said projectile through the atmosphere.

5. The projectile of claim 4 wherein said bias means is a coil spring having one end resting against said saddle and the opposite end resting against at least one of said rings.

6. The projectile of claim 4 wherein said rings are further characterized by an outside ring located adjacent the inside surface of said cylinder; a plurality of successively smaller interior rings provided in concentric, nested relationshsip inside said outside ring; and a closure ring positioned interiorly of the smallest of said interior rings, said closure ring further comprising a dome closing the end of said closure ring at said opposite end of said cylinder.

7. The projectile of claim 4 wherein said rings are further characterized by an outside ring located adjacent the inside surface of said cylinder; a plurality of successively smaller interior rings provided in concentric, nested relationship inside said outside ring; and a closure ring positioned interiorly of the smallest of said interior rings, said closure ring further comprising a dome closing one end of said closure ring at said opposite end of said cylinder and wherein said bias means is a coil spring having one end resting against said saddle and the opposite end resting against said dome.

8. The projectile of claim 7 wherein said threaded member is a brass screw and further comprising a base aperture provided in the base of said saddle for receiving the threads of said brass screw.

* * * * *